US005329076A

United States Patent [19]

Kameli

[11] Patent Number: 5,329,076

[45] Date of Patent: Jul. 12, 1994

[54] ELEVATOR CAR DISPATCHER HAVING ARTIFICIALLY INTELLIGENT SUPERVISOR FOR CROWDS

[75] Inventor: Nader Kameli, Cromwell, Conn.

[73] Assignee: Otis Elevator Company, Farmington, Conn.

[21] Appl. No.: 919,470

[22] Filed: Jul. 24, 1992

[51] Int. Cl.[5] ..... B66D 1/18

[52] U.S. Cl. ..... 187/127; 187/131; 187/125

[58] Field of Search ..... 187/125, 127, 131, 124

[56] References Cited

U.S. PATENT DOCUMENTS

| | | | |
|---|---|---|---|
| 3,561,571 | 2/1971 | Gingrich | 187/29 |
| 3,891,064 | 6/1973 | Clark | 187/29 R |
| 4,044,860 | 8/1977 | Kaneko et al. | 187/29 R |
| 4,193,478 | 3/1980 | Keller et al. | 187/29 R |
| 4,303,851 | 12/1981 | Mottier | 235/92 PK |
| 4,323,142 | 4/1982 | Bittar | 187/29 R |
| 4,330,836 | 5/1982 | Donofrio et al. | 364/567 |
| 4,363,381 | 12/1982 | Bittar | 187/29 R |
| 4,411,338 | 10/1983 | Kuzunuki et al. | 187/29 R |
| 4,473,134 | 9/1984 | Uetani | 187/29 R |
| 4,497,391 | 2/1985 | Mendelsohn et al. | 187/29 R |
| 4,499,975 | 2/1985 | Tsuji | 187/29 R |
| 4,503,941 | 3/1985 | Takabe | 187/29 R |
| 4,523,665 | 6/1985 | Tsuji | 187/29 R |
| 4,536,842 | 8/1985 | Yoneda et al. | 364/424 |
| 4,553,639 | 11/1985 | Uetani | 187/29 R |
| 4,555,724 | 11/1985 | Enriquez | 358/93 |
| 4,562,530 | 12/1985 | Umeda et al. | 364/148 |
| 4,655,325 | 4/1987 | Schroder et al. | 187/127 |
| 4,672,531 | 6/1987 | Uetani | 364/138 |
| 4,677,577 | 6/1987 | Takabe et al. | 364/554 |
| 4,708,224 | 11/1987 | Schrooder | 187/122 |
| 4,718,520 | 1/1988 | Schroder | 187/127 |
| 4,760,896 | 8/1988 | Yamaguchi | 187/124 |
| 4,799,243 | 1/1989 | Zepke | 377/6 |
| 4,802,557 | 2/1989 | Umeda et al. | 187/127 |
| 4,815,568 | 3/1989 | Bittar | 187/127 |
| 4,838,384 | 6/1989 | Thangavelu | 187/125 |
| 4,846,311 | 7/1989 | Thangavelu | 187/125 |
| 4,852,696 | 8/1989 | Fukuda et al. | 187/139 |
| 4,874,063 | 10/1989 | Taylor | 187/130 |
| 4,878,562 | 11/1989 | Schroder | 187/127 |
| 4,926,976 | 5/1990 | Schroder | 187/125 |
| 4,930,603 | 6/1990 | Brenner | 187/125 |
| 4,958,707 | 9/1990 | Yoneda et al. | 187/101 |
| 4,991,694 | 2/1991 | Friedli | 187/127 |
| 5,001,557 | 3/1991 | Begle | 358/113 |
| 5,022,497 | 6/1991 | Thangavelu | 187/124 |
| 5,024,295 | 6/1981 | Thangavelu | 187/125 |
| 5,024,296 | 6/1991 | Kameli | 187/132 |

OTHER PUBLICATIONS

Makridakis, Spyros and Wheelwright, Steven C. *Forecasti Methods and Applications,* Wiley & Sons, New York, 1978, pp. 48–66.

Barney, G. C. and Dos Santos, S. M. *Lift Traffic Analysis Design and Control,* Peter Peregrinus Ltd, Stevenage, Herts., England, 1977, pp. 85–147.

Barney, G. C. and Dos Santos, S. M. *Lift Traffic Analysis Design and Control,* Peter Peregrinus, Ltd., Stevenage, Herts., England, 1977, pp. 24–31; 54–57.

Schutzer, Daniel. *Artificial Intelligence, An Applications-Oriented Approach,* Van Nostrand Reinhold Company, New York, 1987, pp. 1–27.

Kameli, Nader and Thangavelu, Kandasamy, "Intelligent Dispatching Systems", *AI Expert,* Sep. 1989, pp. 32–37.

*Primary Examiner*—Emanuel T. Voeltz
*Assistant Examiner*—Robert Nappi
*Attorney, Agent, or Firm*—Joseph P. Abate

[57] ABSTRACT

An elevator car dispatcher having an artificially intelligent supervisor which generates a crowd prediction signal associated with a particular floor, monitors a condition of a first elevator car which has serviced the predetermined floor and controls the remainder of elevator cars assigned to the predetermined floor dependent upon the condition of the first car.

3 Claims, 10 Drawing Sheets

IN TWO CAR REQUEST

IN THREE CAR REQUEST

TWO CAR OR THREE CAR REQUEST fig. 12
prior art
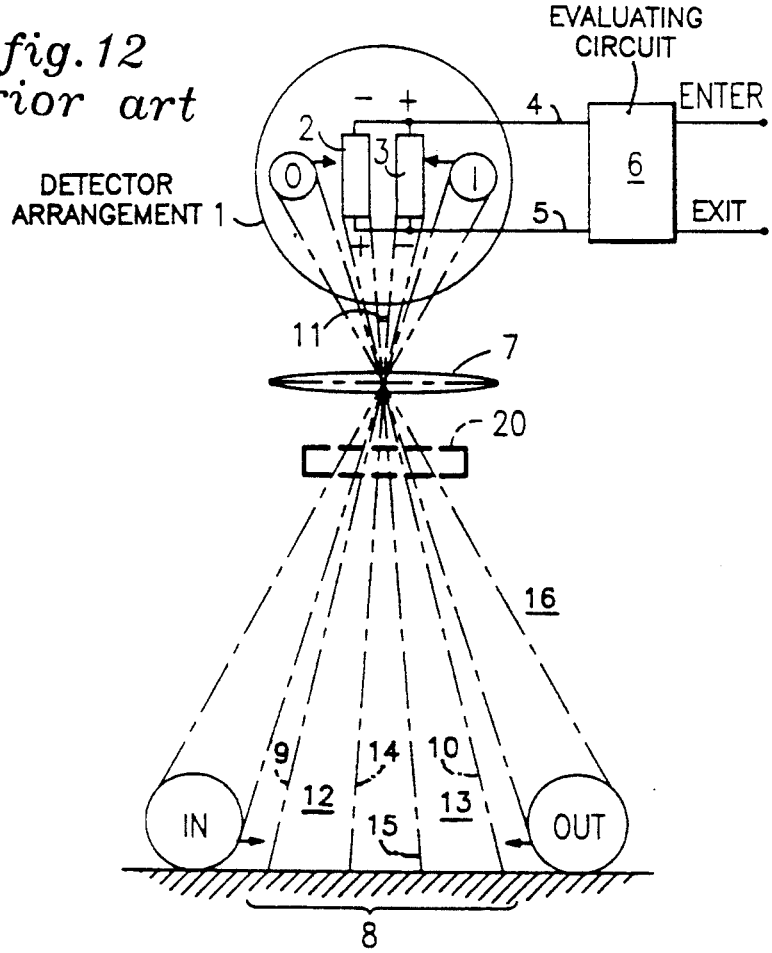
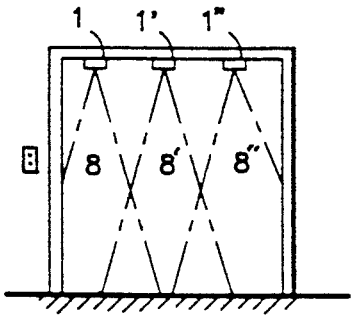
fig. 12A
prior art

ELEVATOR CAR DISPATCHER HAVING ARTIFICIALLY INTELLIGENT SUPERVISOR FOR CROWDS

CROSS-REFERENCE TO RELATED APPLICATIONS

This application relates to subject matter disclosed in the following commonly-owned U.S. patent applications Ser. No. 07/580,888 filed Sep. 11, 1990, "Behavior Based Cyclic Prediction for an Elevator System;" Ser. No. 07/508,312 filed Apr. 12, 1990, "Elevator Dynamic Channeling TM Dispatching for Up-Peak Period;" Ser. No. 07/508,313 filed Apr. 12, 1990, "Elevator Car Assignment to Contiguous Nonoverlapping Sectors during the Up-peak based on Past and Current Traffic and Car Capacity" and Ser. No. 07/580,889 filed Sep. 11, 1990, "Floor Population Detection for an Elevator System," which are all hereby incorporated by reference.

BACKGROUND OF THE INVENTION

1. Field of the Invention

The present invention relates to artificially intelligent elevator systems and, more particularly, to such systems using artificial intelligence for predicting crowds at elevator floors.

2. Description of the Related Art

Arrangements for predicting crowds at predetermined elevators floors and dispatching elevator cars to such floors are known. See, for example, commonly-owned U.S. Pat. Nos. 4,838,384; 4,846,311; 5,022,497; 5,024,295 and 5,035,302 which are all hereby incorporated by reference. The present inventor has developed arrangements for dispatching elevator cars responsive to traffic predictions. See, for example, U.S. patent application No. 07/580,888 filed Sep. 11, 1990 previously incorporated by reference. These various arrangements utilize a plurality of parameters for a predetermined floor to predict (e.g., periodically) a crowd for a particular short time interval. Such parameters include, for example, passenger boarding counts, passenger deboarding counts, hall calls and car calls for that floor. Such parameters are substantially continuously manipulated and stored by suitable programming within a microcomputer to produce both "real time" and "historic" databases which are utilized to predict crowds. The crowd predictions are then utilized by the elevator system to improve service to floors for which a crowd is predicted. The predictions are based on known prediction or forecasting techniques, such as single exponential smoothing and/or linear exponential smoothing discussed in *Forecasting Methods and Applications* by Spiro Makridakis and Steven C. Wheelwright (John Wiley and Sons, Inc., 1978) particularly in section 3.6: "Linear Exponential Smoothing." Linear exponential smoothing is based on Brown's one-parameter linear exponential smoothing of the Makridakis and Wheelwright text (see page 61 et seq.) and is represented by the following equation:

$$P(t+m)=2S'(t)-S''(t)+Am/(1-A)\{S'(t)-S''(t)\}$$

where $$S'(t)=AX(t)+(1-A)S'(t-1)$$

$$S'(0)=X(0)$$

$$S''(t)=AS'(t)+(1-A)S''(t-1)$$

$$S''(0)=X(0)$$

and

P(t+m) is the prediction for "m" intervals now,

S'(t) is a single smoothing value,

S''(t) is a double smoothing value,

A is a weighing factor and is a pure number, for example, two-tenths (0.2), m is the number of intervals ahead to be predicted, which could be, for example, two intervals, with an exemplary time interval being a one minute time period, x(o) is an initial value of the parameter being predicted, and x(t) is an observed value of the parameter being predicted at time t.

Further discussion of these prediction techniques is set forth in the commonly-owned U.S. patents and applications previously incorporated by reference. The crowd predicting and elevator dispatching arrangements discussed above have improved elevator system efficiency, but they have not proven to be entirely satisfactory. Although a crowd is predicted for a short time interval (e.g., several minutes) for a particular or predetermined floor, that crowd may not exist in real time. Dispatching elevator cars to a floor for which a crowd is predicted is inefficient if such crowd does not exist in real time.

Accordingly, the present invention employs an artificially intelligent (AI) supervisor to monitor at least one condition (e.g., load weight) of a first elevator car dispatched to a predetermined floor at which a crowd is predicted and to control the remainder of cars assigned to that floor dependent upon the monitored condition.

It is a principal object of the present invention to increase the efficiency of artificially intelligent elevator systems.

It is a further object of the present invention to employ real time data from one car servicing a particular floor during a short time interval to control the assignment of other cars to that floor during that interval.

Further and still other objects of the present invention will become more readily apparent in view of the following detailed description when taken in conjunction with the accompanying drawing, in which:

BRIEF DESCRIPTION OF THE DRAWING

FIGS. 12, 12A and 13 are two alternative crowd sensor arrangements which ascertain the number of people at a predetermined floor and which generate crowd sensor signals.

DETAILED DESCRIPTION OF THE PREFERRED EMBODIMENTS

Figure 1:
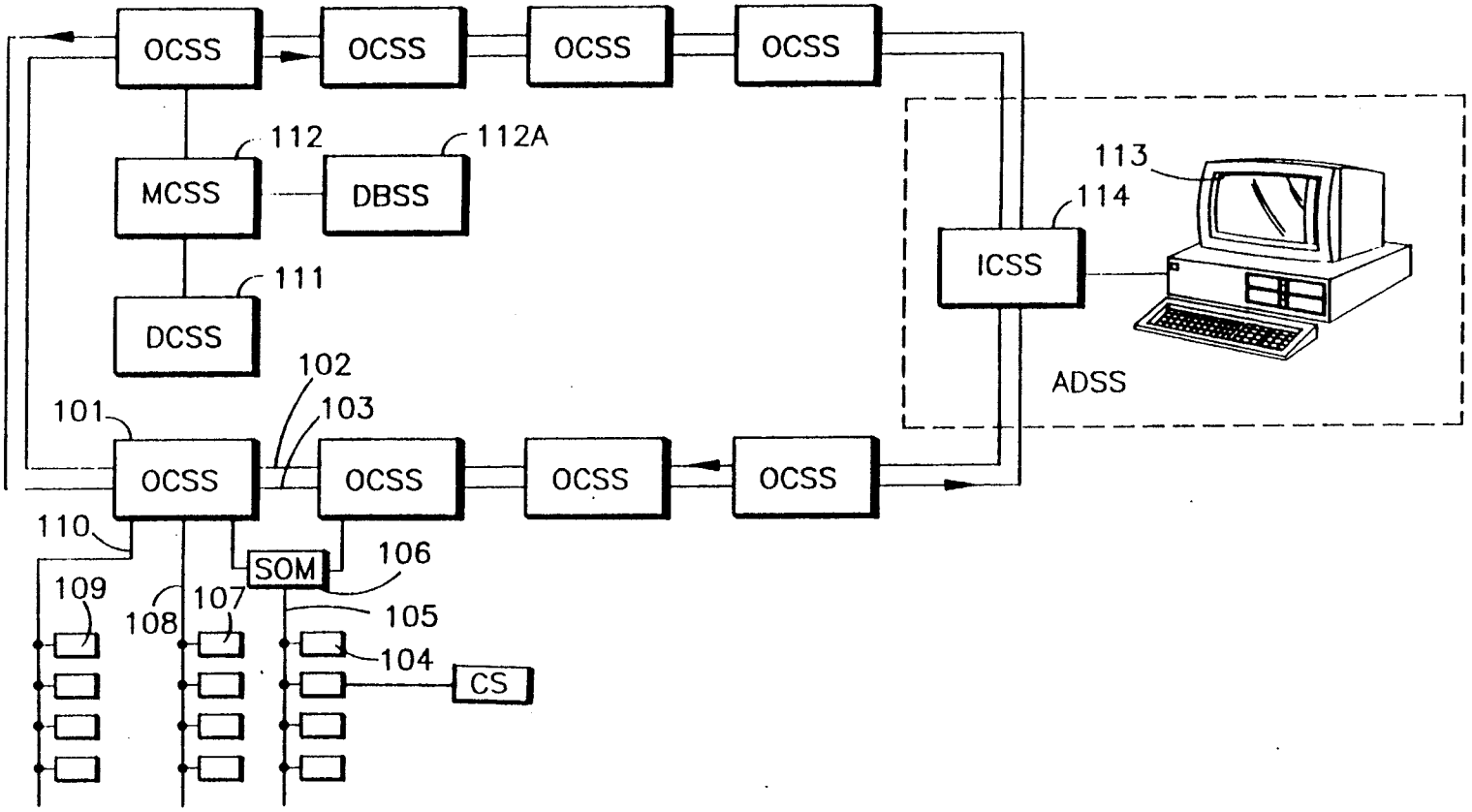
fig. 1 prior art
FIG. 1 is a simplified schematic block diagram of an exemplary ring communication system for elevator group control in which the present invention may be implemented.
Figure 10:
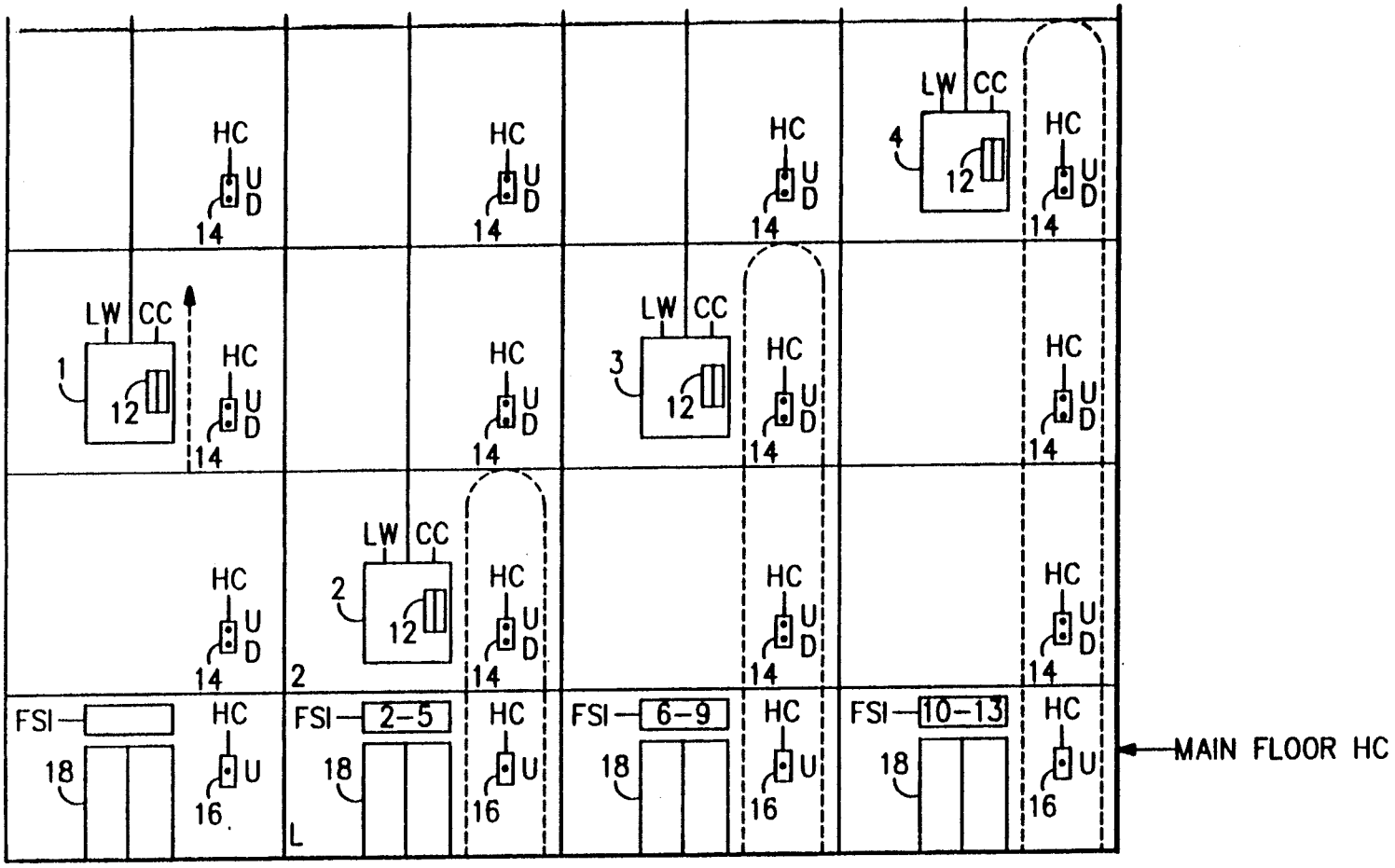
fig. 10 prior art
FIG. 10 is a schematic diagram of four elevator cars controllable by the system in FIG. 1 and by the present invention.

FIG. 1 shows an elevator system configuration (e.g., eight car group) which implements the AI supervisor of the present invention. Various aspects of the elevator system configuration of FIG. 1 are described in commonly owned U.S. Pat. No. 5,202,540, "Two-Way Ring Communication System for Elevator Group Control", By Auer and Jürgen issued Apr. 13, 1993, which is hereby incorporated by reference. See also FIG. 10 which shows four cars 1–4, operating panels 12, hall call signals HC, car call signals CC, and load weight signals LW. In FIG. 1, elevator group control is distributed to separate microprocessor control subsystems, operational control subsystems (OCSS) 101, which are all interconnected to form a two-way ring communication network by means of communication links 102,103. Associated with each OCSS 101 is a number of other subsystems 111, 112, 112(A), signaling devices and other systems (e.g. a plurality of crowd sensors CS for each floor) as hereinafter more fully described.

Hall buttons and lights are connected with remote station 104 and remote serial communication links 105 to the OCSS 101 via a switch-over module 106. The car buttons, lights and switches are connected through similar remote stations 107 and serial links 108 to the OCSS 101. The car specific call features, such as car direction and position indicators, are connected through remote stations 109 and remote serial link 110 to the OCSS 101.

A car load measurement is periodically read by a door control subsystem (DCSS) 111 which is a part of the car controller. The DCSS 111 generates a load signal LW which is sent to a motion control subsystem (MCSS) 112 which is also part of the car controller. This load signal LW in turn is sent to the OCSS 101. DCSS 111 and MCSS 112 are microprocessor controlled subsystems which control door operation and car motion and are under the control of the OCSS 101. Each MCSS 112 works in conjunction with a drive and brake subsystem DBSS 112(A).

A dispatching function for each car is executed by the OCSS 101 under control of an advanced dispatcher subsystem (ADSS). The ADSS includes a microcomputer 113 and an information control subsystem ICSS 114. The car load measured is converted into boarding and deboarding passenger counts by the MCSS 112 and sent to the OCSS 101. The OCSS sends this data to the ICSS of the advanced dispatcher subsystem ADSS. The microcomputer 113, through signal processing, collects all suitable data such as passenger boarding and deboarding counts at the various floors for various time periods, hall calls and car calls, etc., so that, in accordance with suitable programming, the microcomputer utilizes historic (e.g., daily) data and real time (e.g., past few minutes) data, to create historical and real-time databases, to produce by suitable prediction methodology a crowd prediction for a particular floor and short time interval and then to assign elevator cars to that floor.

Figure 3:
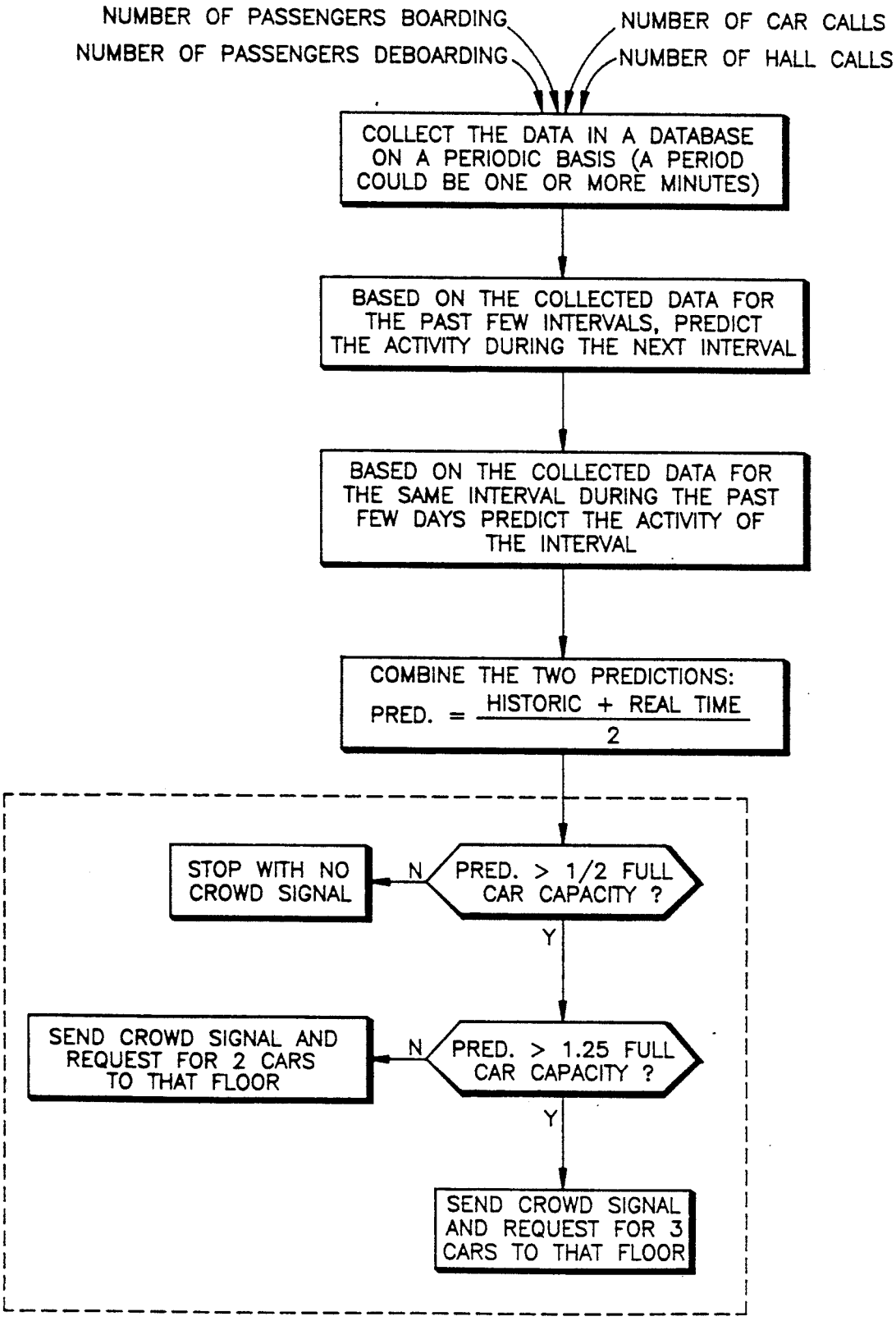
FIG. 3 is a simplified, high level logic flow diagram showing a routine for generating crowd signals which are employed in the present invention.
Figure 4:
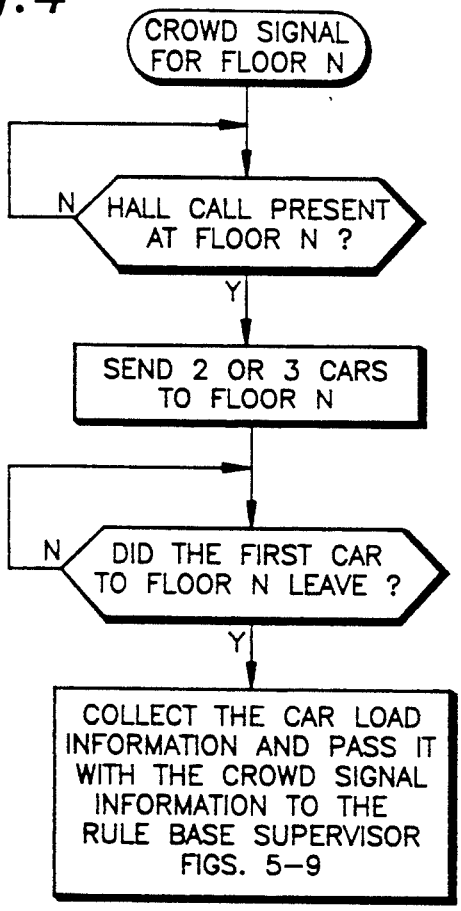
FIGS. 4–9 are high level logic flow diagrams showing the various routines according to the artificially intelligent supervisor of the present invention.
Figure 5:
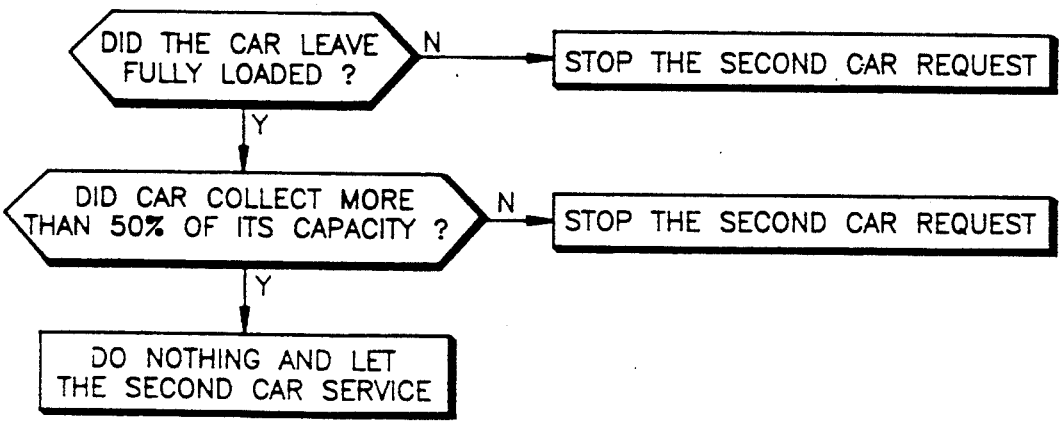
Figure 6:
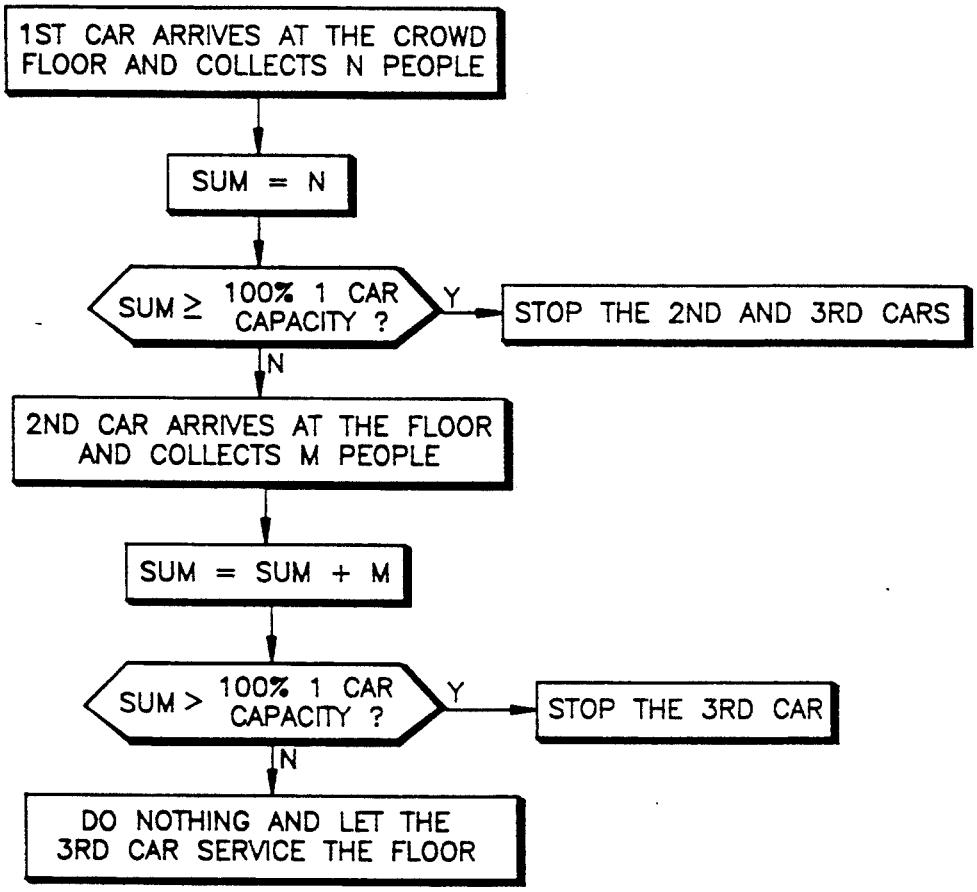
Figure 7:
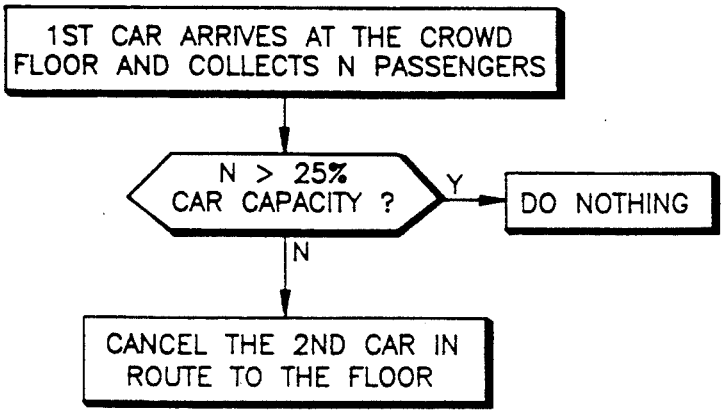
Figure 8:
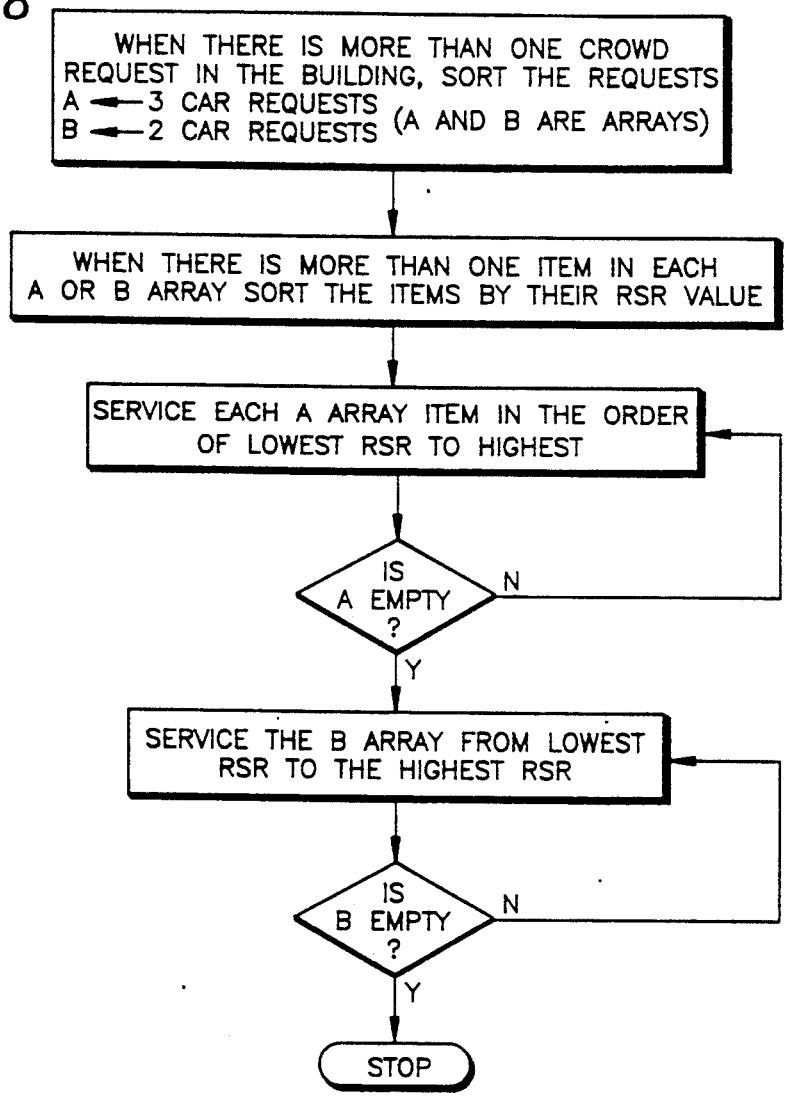
Figure 9:
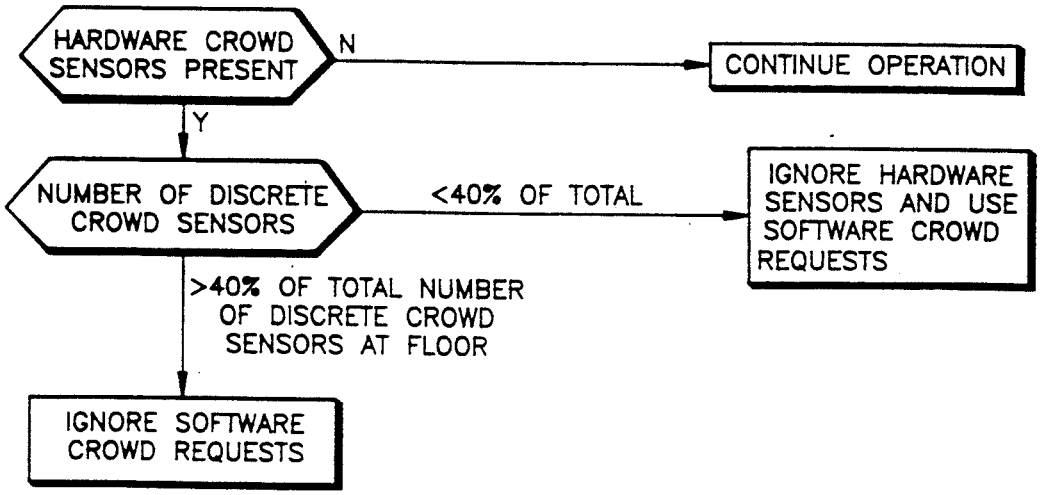
Figure 11:
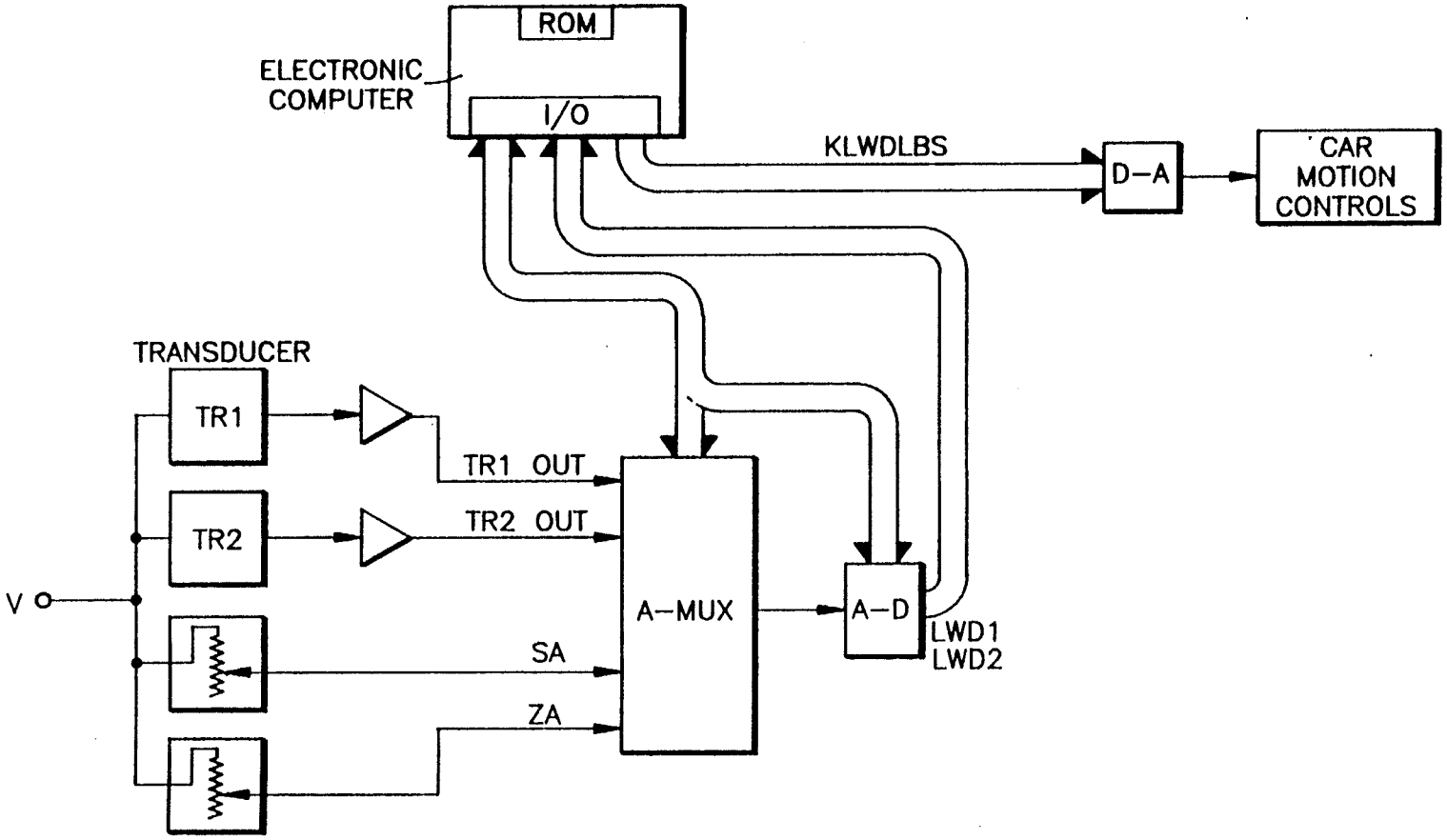
fig. 11 prior art
FIG. 11 is a car load weighing arrangement for generating a load weighing signal LW.
Figure 13:
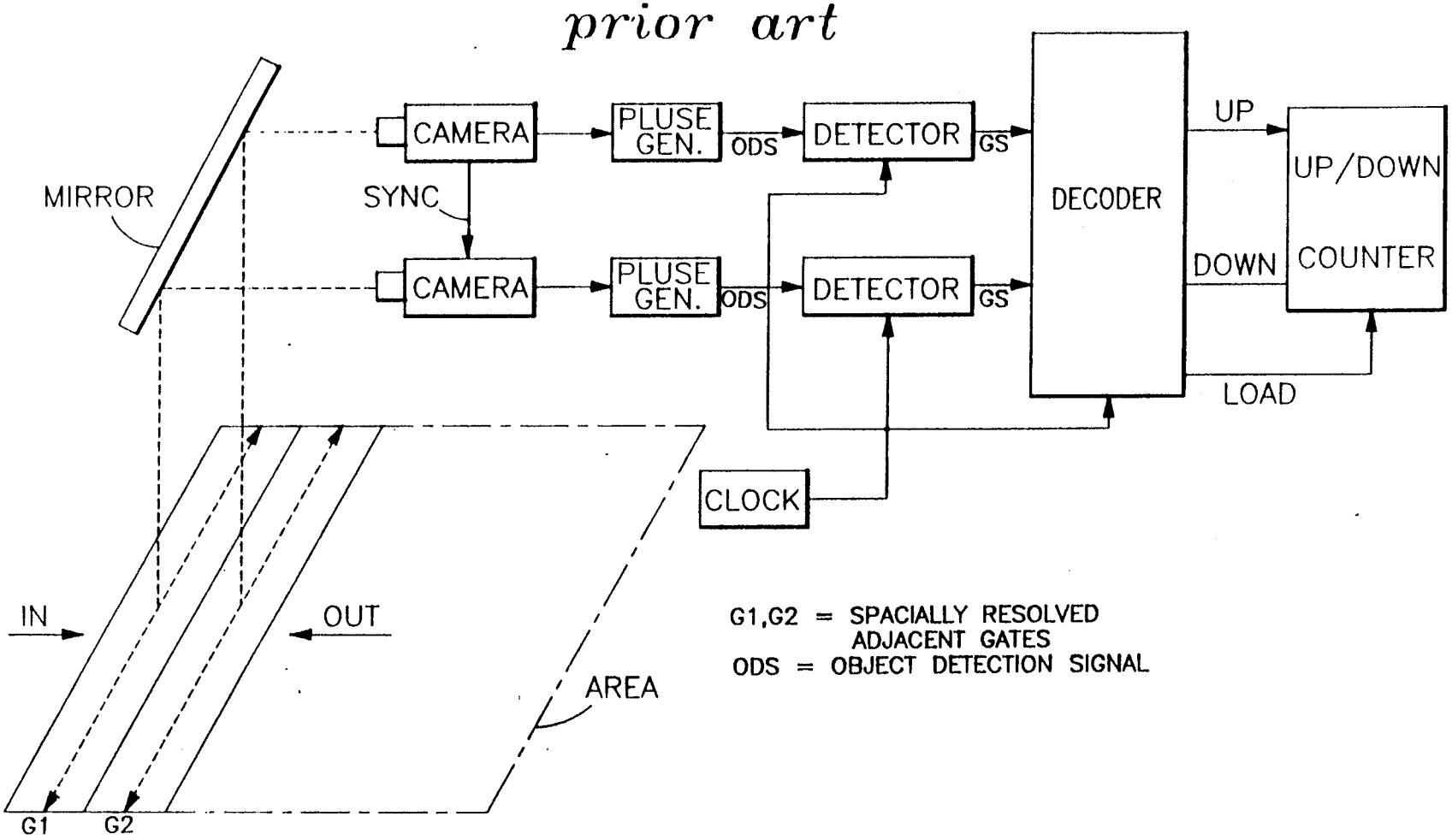
fig. 13 prior art

Each OCSS 101 includes a suitable elevator car dispatching routine (for example, a relative system response (RSR) routine as set forth in commonly-owned U.S. Pat. No. 4,363,381 which is hereby incorporated by reference) to control elevator dispatching at all times when the routines of the invention shown in both FIG. 3 (dashed box) and FIGS. 4–9 are not in control—for example, when no crowd is predicted. The remaining routine shown in FIG. 3 is executed periodically (e.g., every minute) or during other suitable periods by the microcomputer 113. Also, multitasking based software could be used to suitably run all routines simultaneously. For a general discussion of artificially intelligent based elevator systems, see the magazine article entitled "Intelligent Elevator Dispatching Systems" by Nader Kameli and Kandasamy Thangavelu (*AI Expert*, September 1989; pages 32–37). The microcomputer 113 can collect data on individual and group demands throughout a day to arrive at a historical record of traffic demands for each day of the week and compare it to actual demand to adjust overall dispatching sequences to achieve a desired performance. Car loading and floor traffic are also analyzed through the signal LW from each car (see FIG. 11) and through people signals CS from traffic sensors located at each floor (see FIGS. 12, 13).

Real time floor traffic is sensed and suitable electrical signals CS are generated by, for example, a plurality of people sensors CS located on each floor. See commonly-owned U.S. Pat. Nos. 4,330,836; 4,303,851; 4,799,243; and 4,874,063 which are all hereby incorporated by reference.

Figure 2:
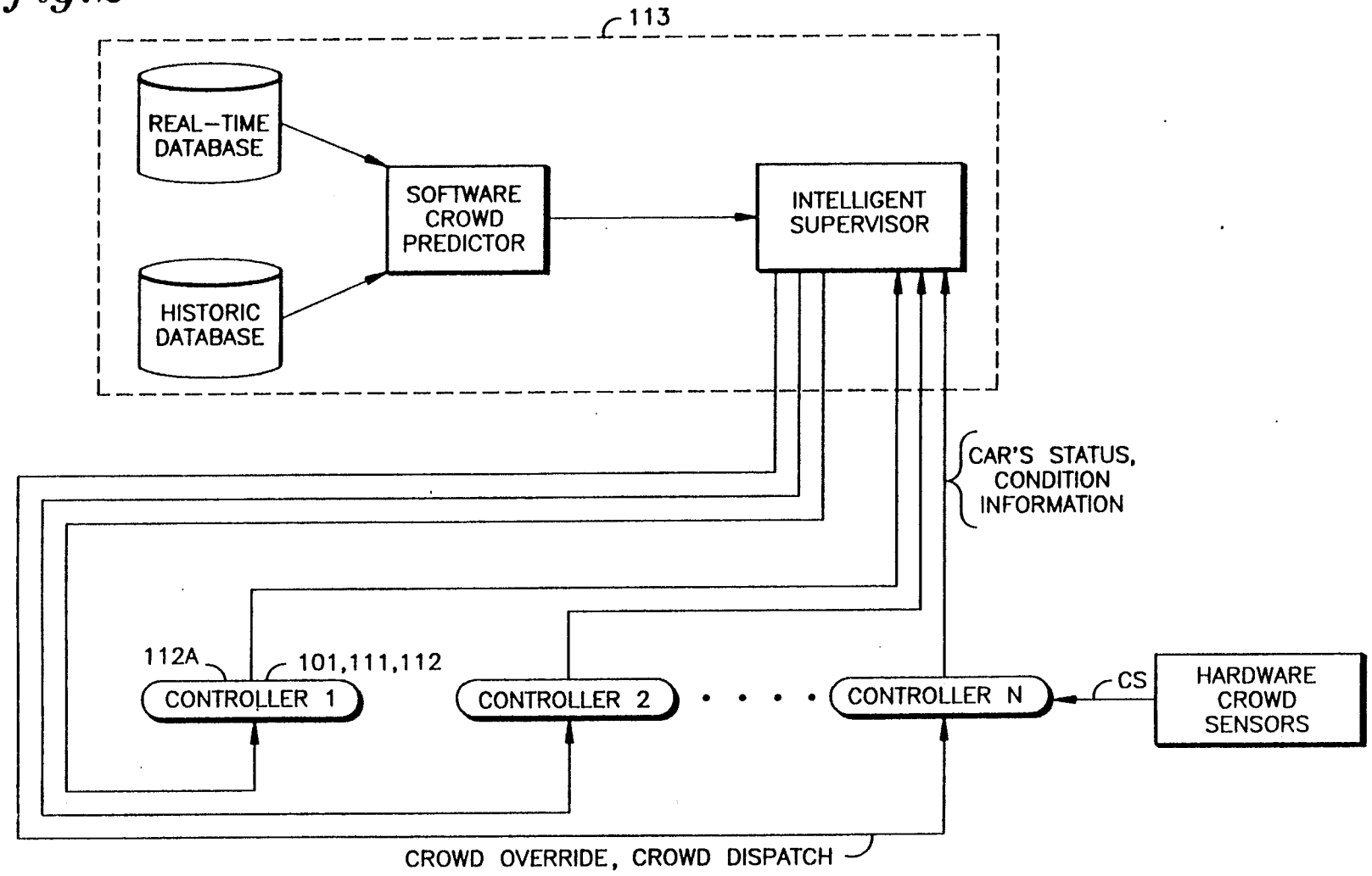
FIG. 2 is a simplified schematic block diagram of the present invention.

According to the invention as shown in FIG. 2 and in the high level logic flow diagrams of FIGS. 3–9, real time data and historic data are utilized by microcomputer 113 to predict a crowd during a particular short time interval (e.g., one minute) at a predetermined floor in a building. In the event that a crowd (large or small) is predicted, a suitable crowd signal is generated within the microcomputer 113 for a suitable time interval (e.g., one minute). If a hall call is registered for the predetermined floor while a crowd signal is active, two or three cars are assigned (depending on the size of the crowd predicted) and dispatched to the predetermined floor while a crowd signal is active according to the routine of FIG. 4. Also according to the present invention, a condition (capacity or load weight) is monitored by appropriate sensors associated with the elevator car, and such monitored information is transmitted (e.g., signal LW) to the microcomputer 113 via communications link 102,103 and the ICSS 114. Depending upon the load condition of the first car as it leaves the predetermined floor, the intelligent supervisor of the present invention controls (e.g., cancels) the assignment of the remaining cars according to the routines of FIGS. 5, 6 and 7. In that event (cancellation), control of the elevator system will default (e.g., call) to known routines as disclosed, for example, in U.S. Pat. No. 4,363,381. Multiple crowd signals (requests) are handled by the invention according to the flow diagram of FIG. 8. According to the routine as set forth in FIG. 9, hardware crowd sensors CS disposed at each particular floor sense the actual number of people boarding the first car and generate signal CS corresponding to the actual number of people boarding. Thus, real time data, either from load weight signals or crowd sensor signals, are utilized by the microcomputer 113 to control a second and subsequent elevator car dispatched to a floor at which a crowd is predicted.

Thus, the supervisor of the preferred embodiment includes hardware and intelligent software (e.g., rulebased) to monitor the crowd signals generated by the ADSS and the incoming data from the car controllers to decide the optimal operation. These rules look at the predicted crowds, presence of hall call, number of crowd signals active for the entire building, number of people actually behind the call, number of cars in the group, etc. to make up the final decision. These rules (FIGS. 4–9) are discussed more fully below:

When answering the crowd signal at the crowd floor, if the first car in a two-car request or the second car in a three-car request is fully loaded at the stop and the number of people boarding the car meets or exceeds a first predetermined threshold (e.g., 50%) of the car's capacity, the crowd is answered. Therefore, any other car scheduled to stop at that floor can be cancelled and the crowd signal for that interval should be reset (i.e., inactivated).

When answering the crowd signal at the crowd floor, in a three-car request, if the total number of people boarding the cars serving the crowd exceeds a second predetermined threshold (e.g., 100%) of a car's capacity, any other scheduled car to that floor should be cancelled and the crowd signal for that interval can be reset.

When answering the crowd signal at the crowd floor, if the first car serving a crowd picks up less than a third predetermined threshold (e.g., 25%) of a car's capacity, the other cars scheduled to stop at that floor should be cancelled since the call answered was not the crowd expected. The crowd signal will remain active.

There will always be one car in the group that is exempt from crowd service. This car will be the one with the best possible RSR to serve the remainder of the building. This guarantees service to other portions of the building no matter how small they might be. This also means that if a group is made up of two cars, crowd sensing is meaningless.

It is more than likely that there will be more than one crowd expected in a building. Since there are not enough cars to dispatch to every floor that is expected to have a crowd during a rush period, crowd service will be scheduled. Because all the crowds share the same interval, concept of time is meaningless. The crowds will be scheduled in terms of their size and their expected service time. Crowds can be divided into two major classes: (1) large and (2) small. A large crowd is a signal that requires three cars for service where the small crowd requires only two. The large crowds have a higher priority for service. Within each class there is one more parameter(s) that is used to prioritize the members of the class. That is their RSR value. Crowds within each class will be organized based on their Relative System Response time. The one with the shortest response time will have the highest priority for service. This is so that the average service time of the system is reduced.

There is a possibility of a tie between two or more of the floors/crowds in the scheme. If a tie should appear, the expected number of people behind the hall crowd, which is also communicated to the car controllers, will be used to separate them. The call with the highest number of people waiting will get the highest priority.

There are situations where a floor has hardware crowd sensors. If a floor has a hardware crowd sensor(s), the software crowd signals will be ignored for that floor, until such time that the hardware crowd sensors are disabled.

There are n discrete crowd sensors for each car at each floor. The total number of crowd signals for a floor add to be N (N=n * total number of cars). If over 40% of N is inoperative, then flag the hardware crowd sensing for that floor as disabled and use the software crowd sensor.

Finally, suitably coding all of the routines set forth in FIGS. 3 through 9 is well within the skill of the art in view of the instant specification.

While what has been shown and described is what at present are considered preferred embodiments of the present invention, those skilled in the art will understand that various changes and modifications may be made therein without departing from the spirit and scope of the present invention which shall be limited only by the appended claims.

What is claimed is:

1. A method for dispatching elevator cars, comprising:

predicting a crowd size at a predetermined floor for a predetermined time interval;

comparing the predicted crowed size with a first crowd size threshold equal to ½ of a full capacity of an elevator car;

comparing the predicted crowd size with a second crowd size threshold if the predicted crowd size exceeds the first crowd size threshold, the second crowd size threshold being greater than the first crowd size threshold;

generating a crowd signal for the predetermined floor if the crowd size exceeds the first crowd size threshold;

receiving a hall call signal for the predetermined floor;

assigning at least three elevator cars to be predetermined floor responsive to the hall call signal only after said crowd signal generating step and only if the predicted crowd size is greater than the first crowd size threshold and the second crowd size threshold;

monitoring a number of passengers collected by one of the at least three elevator cars at the predetermined floor, and then canceling the assignment of the at least second and third elevator cars to the predetermined floor if the number of passengers collected at the predetermined floor by the one of the elevator cars is at least equal to 100% of a full capacity of the one car.

2. A method as claimed in claim 1, wherein said second step of comparing the predicted crowd size includes comparing the predicted crowd size with a second crowd size threshold equal to 125% of a full capacity of the elevator car if the predicted crowd size exceeds the first crowd size threshold.

3. A method as claimed in claim 1, further comprising the step of monitoring a number of passengers collected by another of the at least three elevator cars at the predetermined floor, and then canceling the assignment of the third elevator car to the predetermined floor if a total number of passengers collected at the predetermined floor by the one and the another elevator cars is greater than 100% full of a full car capacity of the another car.

* * * * *

UNITED STATES PATENT AND TRADEMARK OFFICE

CERTIFICATE OF CORRECTION

PATENT NO. : 5,329,076

DATED : July 12, 1994

INVENTOR(S) : Nader Kameli

It is certified that error appears in the above-identified patent and that said Letters Patent is hereby corrected as shown below:

Col. 6, line 37, change "be" to--the--.

Signed and Sealed this

Third Day of January, 1995

*Attest:*

*Attesting Officer*

BRUCE LEHMAN

*Commissioner of Patents and Trademarks*